United States Patent [19]

Noneman et al.

[11] 3,967,870

[45] *July 6, 1976

[54] MOLDED PLASTIC DRAWER

[75] Inventors: Thomas S. Noneman; Thomas R. Smith; John B. Stokes, all of Bryan, Ohio

[73] Assignee: Tomco Plastics, Inc., Byron, Ohio

[ * ] Notice: The portion of the term of this patent subsequent to June 17, 1992, has been disclaimed.

[22] Filed: Mar. 12, 1975

[21] Appl. No.: 557,527

Related U.S. Application Data

[63] Continuation-in-part of Ser. No. 393,944, Sept. 4, 1973, Pat. No. 3,890,024.

[52] U.S. Cl. ..... 312/330 SM; 312/345; 312/348; 206/507; 220/DIG. 12

[51] Int. Cl.[2] ..... A47B 88/04

[58] Field of Search ..... 312/330, 348, 345

[56] References Cited

UNITED STATES PATENTS

| | | | |
|---|---|---|---|
| 328,015 | 10/1885 | Davis | 312/347 |
| 1,946,789 | 2/1934 | Giesmann | 312/342 |
| 2,668,746 | 2/1954 | Weiskopf | 312/347 |
| 3,147,882 | 9/1964 | Waters | 206/507 |
| 3,447,715 | 6/1969 | Beney | 206/507 |
| 3,490,602 | 1/1970 | Wentzel | 211/126 |
| 3,582,174 | 6/1971 | Riley | 312/345 |
| 3,784,274 | 1/1974 | Holmes et al. | 312/330 |
| 3,890,024 | 6/1975 | Noneman et al. | 312/330 |

*Primary Examiner*—Paul R. Gilliam
*Assistant Examiner*—Victor N. Sakran
*Attorney, Agent, or Firm*—Richards, Harris and Medlock

[57] ABSTRACT

A molded plastic drawer for use in cabinets having spaced, parallel guide rails comprises a normally horizontally disposed bottom wall and front, side and back walls extending upwardly from the bottom wall. The bottom wall is provided with guide members which engage the lower guide rails of the cabinet to guide the drawer during movement between opened and closed conditions. The side and back walls of the cabinet extend to horizontal lips and may be provided with ribs which reinforce the walls and the lips. The horizontal lip of the back wall is positioned above the lips of the side wall and extends across the full width of the drawer to define an elongate shoulder positioned for engagement with structure of the cabinet when the drawer is in the opened condition to prevent the drawer from falling out of the cabinet. The upper portion of the back wall further comprises grooves which receive the upper guide rails of the cabinet and thereby cooperates with guide portions on the bottom wall to guide the drawer during inward and outward movement relative to the cabinet.

10 Claims, 2 Drawing Figures

MOLDED PLASTIC DRAWER

CROSS REFERENCE TO RELATED APPLICATION

This application is a continuation-in-part of co-pending application Ser. No. 393,944, filed Sept. 4, 1973, now U.S. Pat. No. 3,890,024.

BACKGROUND AND SUMMARY OF THE INVENTION

This invention relates to molded plastic drawers, and more particularly to a molded plastic drawer which is characterized by superior strength and guiding characteristics.

Recreational vehicles such as travel trailers, motor homes, and the like are frequently equipped with cabinets having guide rails. More recently, cabinets of this type have come into use in mobile homes, apartments, etc. In such instances it is necessary to provide drawers for the cabinets which have structure that receives the guide rails and thereby guides the drawers during inward and outward movement.

It is well known that drawers fabricated by the injection molding process are well suited for use in cabinets having guide rails. For example, U.S. Pat. No. 3,796,474 granted to the applicants herein on Mar. 12, 1974, discloses a molded plastic drawer which has gained wide-spread commercial acceptance. However, notwithstanding the relatively widespread use of molded plastic doors in such applications, a number of problems have remained unsolved. For example, in the case of relatively wide drawers, it has been found that central guide rails disposed above and below the drawer do not provide sufficient guiding to prevent skewing of the drawer as it is opened.

Co-pending applicaton Ser. No. 393,494 filed by the applicants herein on Sept. 4, 1973, discloses a drawer adapted for use in conjunction with cabinets having spaced, parallel guide rails situated both above and below the drawer. The drawer is in turn provided with structure for receiving the spaced, parallel guide rails to guide the drawer as it is opened and closed. The drawer is further characterized by reinforcing ribs on the bottom wall thereof which both serve to engage the bottom guide rails of the cabinet to guide the drawer and to engage structure at the front of the cabinet to retain the drawer in the closed condition. Drawers of this type are considered advantageous for use in recreational vehicles and similar applications wherein a relatively inexpensive drawer having structure for retaining the drawer in the closed condition during travel is desired. On the other hand, such a drawer has been found to be unsatisfactory for such applications as mobile homes, apartments, etc. due to the fact that the reinforcing structure on the bottom of the drawer causes interference with the normal opening and closing movements thereof.

The present invention comprises a molded plastic drawer which overcomes the foregoing and other problems. In accordance with the broader aspects of the invention, a molded plastic drawer for use in cabinets having spaced, parallel guide rails includes a bottom wall having guide members on its underside which are positioned to receive the lower spaced, parallel guide rails of the cabinet. The guide members are located at the rear of the drawer and extend only a relatively short distance forwardly, whereby the guide members do not interfere with normal drawer movement. On the other hand, the guiding members provide superior guiding characteristics for the drawer as it is opened and closed, and also prevent the drawer from being inadvertently pulled out of the cabinet.

The drawer further comprises front, side and back walls extending upwardly from the bottom wall. The side walls and the back wall are provided with horizontal lips. However, the lip of the back wall is positioned substantially above the lips of the side walls and is equipped with grooves for receiving the upper spaced, parallel guide rails of the cabinet. By this means there is provided a shoulder extending entirely across the drawer which retains the drawer in the opened condition.

In accordance with more specific aspects of the invention, the side and back walls of the drawer may be provided with a plurality of downwardly extending reinforcing ribs. Each rib may include a downwardly facing edge positioned in alignment with and spaced a predetermined distance from the upper surface of the corresponding portion of the horizontal lips of the drawer. By this means there is provided a series of stacking lugs spaced around the periphery of the drawer which serve to prevent excessive nesting of stacked drawers.

DESCRIPTION OF THE DRAWINGS

A more complete understanding of the invention may be had by referring to the following Detailed Description when taken in conjunction with the accompanying Drawings, wherein.

DETAILED DESCRIPTION

Figure 1:
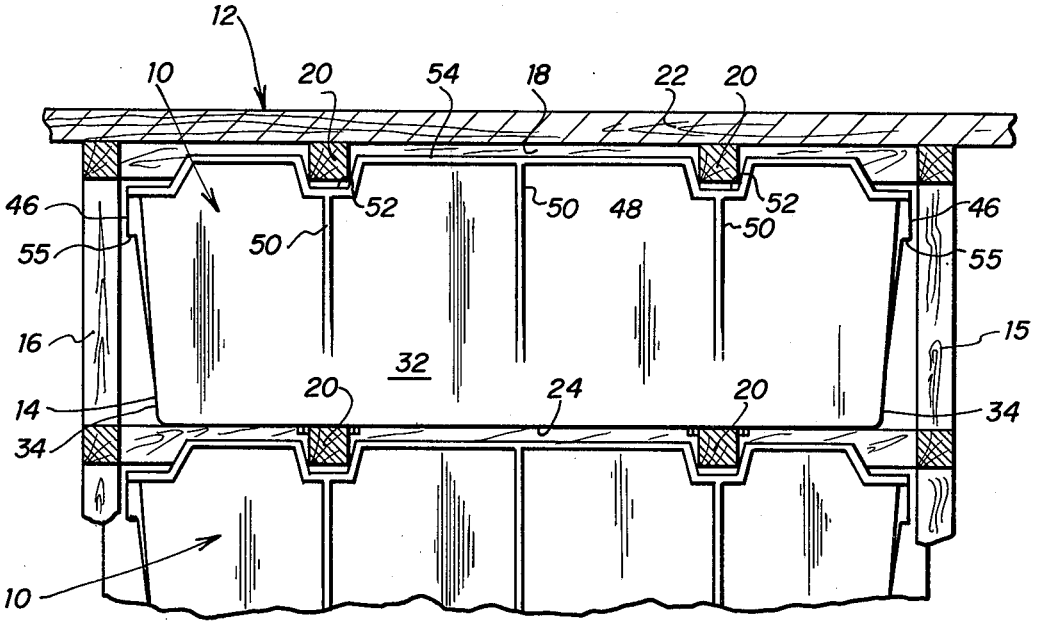
FIG. 1 is a back view of the drawer incorporating the invention and showing the drawer in use.

Referring now to the Drawings and particularly to FIG. 1, there is shown a pair of drawers 10 incorporating the present invention. The drawers 10 are normally housed in a cabinet 12 of the type utilized in such applications as mobile homes, apartments, etc. The cabinet 12 comprises one or more spaces 14 each of which receives one of the drawers 10.

More specifically, the cabinet 12 comprises vertical framing members 16 and horizontal framing members 18 extending between and connected to the vertical framing members 16. The framing members 16 and 18 of the cabinet 12 are typically so arranged as to define the outline of each drawer receiving space 14 in the cabinet 12. Parallel guide rails 20 extend between the horizontal framing members 18 and are disposed at spaced intervals relative to the vertical framing members 16. It will be understood that in the case of a cabinet 12 having vertically stacked drawer receiving spaces 14, certain of the guide rails 20 serve both as the upper guide rails for one drawer receiving space 14 and as the lower guide rails for the next adjacent drawer receiving space 14. In many applications the cabinet 12 further includes an upper panel 22 which serves both to enclose the cabinet and as a shelf or countertop.

Figure 2:
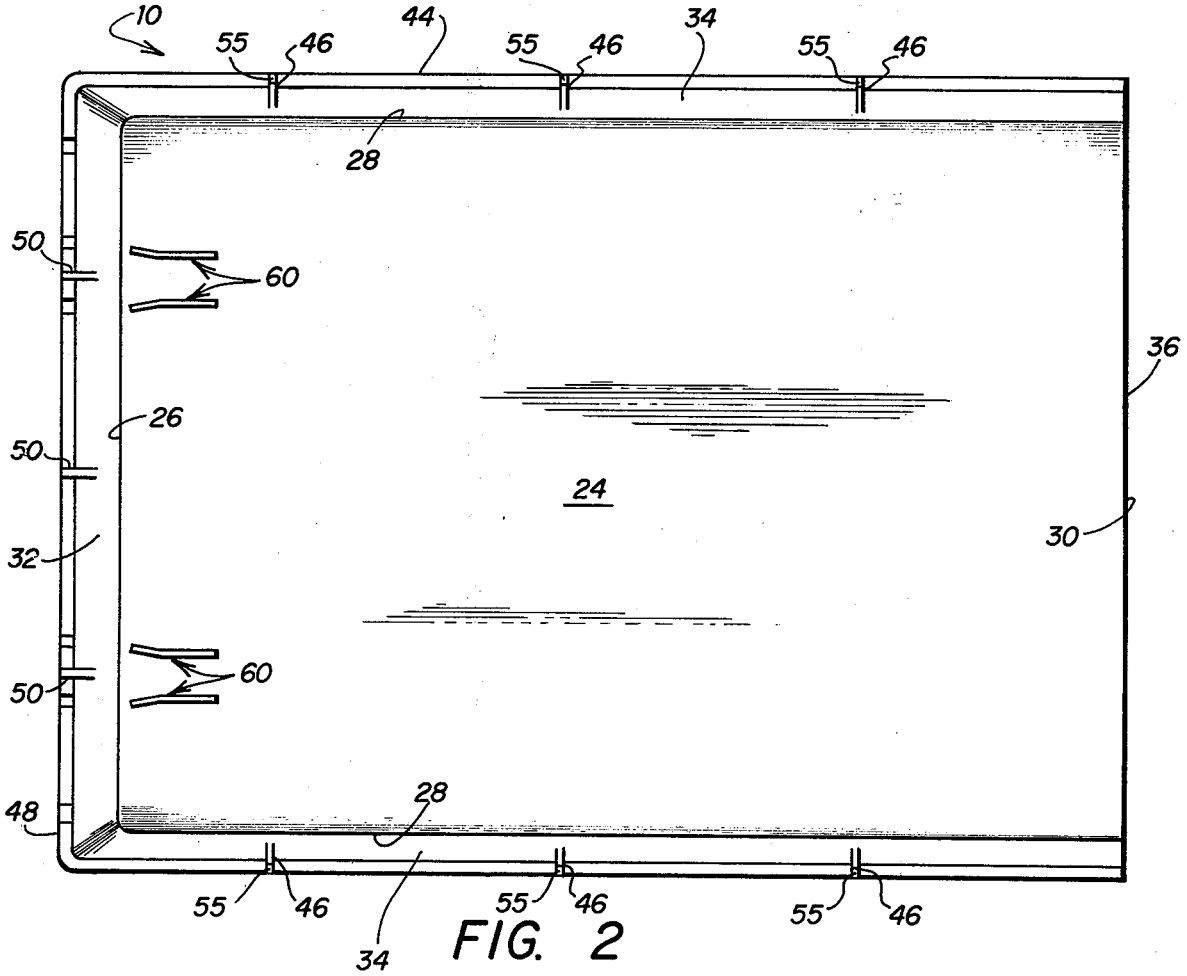
FIG. 2 is a bottom view of the drawer shown in FIG. 1.

Referring now to FIG. 2, the drawer 10 comprises a normally horizontally disposed bottom wall 24 having a rear edge 26, opposed side edges 28 and a front edge 30. A back wall 32 and opposed side walls 34 extend vertically and slightly outwardly from the back and side edges 26 and 28 of the bottom wall 24, respectively. A front wall 36 extends vertically from the front edge 30 of the bottom wall 24. The front wall 36 is adapted to receive a decorative face plate which is secured to the front wall 36 of the drawer 10 by threaded fasteners or other suitable means. The face plate may be formed from wood, plastic or other materials as desired, and may include a drawer pull and/or other hardware.

The side walls 34 of the drawer 10 extend upwardly from the bottom wall 24 to upper horizontal lips 44. Each side wall 34 may be provided with a plurality of ribs 46 serving to reinforce both the side wall 34 and the lip 44. Each rib 46 may extend first downwardly from the corresponding lip 44 and then inwardly to define a stacking lug 55. The back wall 34 is similarly constructed in that it extends to an upper horizontal lip 48 and may be provided with a plurality of outwardly extending ribs 50 serving to reinforce both the back wall 32 and the lip 48.

The lip 48 of the back wall 32 is positioned substantially above the lips 44 of the side walls 34 and is provided with a pair of spaced apart grooves 52. The grooves 52 of the back wall 32 are adapted to receive the upper guide rails 20 of one of the drawer receiving spaces 14, and therefore serve to guide the drawer 10 during inward and outward movement thereof relative to the cabinet 12. The positioning of the lip 48 of the rear wall 32 substantially above the horizontal lips 44 of the side wall 34 provides a shoulder 54 at the upper edge of the back wall 32 which extends substantially the entire width of the drawer 10. The shoulder 54 therefore serves to retain the drawer 10 in the opened condition by means of substantially full width engagement with the upper horizontal framing member 18 comprising the particular space 14 of the cabinet 12.

As is best shown in FIG. 2 the underside of the bottom wall 34 of the drawer 10 is provided with two sets of spaced apart guide members 60. The guide members 60 extend generally parallel to the side edges 28 of the bottom wall 24 from points adjacent to the rear edge 26 to points located only a relatively short distance forwardly therefrom.

As is best shown in FIG. 1, the guiding members 60 of the drawer 10 engage the lower guide rails 20 of the space 14 which receives the drawer 10. By this means the guiding members 60 cooperate with the grooves 52 of the back wall 32 to guide the drawer 10 during inward and outward movement of the drawer relative to the cabinet 12. The guide members 60 also prevent the drawer 10 from being inadvertently pulled out of the cabinet 12. It is important that the guide members 60 be positioned at the extreme rear of the bottom wall 24 and have a reduced length in order to assure proper guiding of the drawer while eliminating possible interference with drawer movement. A guide member length of about two inches to about three inches has been found to provide superior results.

The drawer 10 of the present invention is adapted to be manufactured by means of the injection molding process. As compared with prior molded plastic drawers, the drawer of the prevent invention is adapted to be manufactured in such a way as to provide a considerably greater wall thickness. For example, the wall thickness of drawers incorporating the invention may be of an order of magnitude of approximately 0.125 inches. This is advantageous in eliminating the reinforcing ribs which have characterized the bottom surfaces of prior molded plastic drawers without sacrificing the capacity of the drawer to carry substantially heavy loads.

The elimination of the reinforcing ribs from the bottom surface of the drawer is in turn advantageous in that the drawer is adapted to be moved in and out of the cabinet without encountering any interference whatsoever. This is advantageous in that the drawer simulates the movement of more conventional drawer designs while retaining the economic and other advantages of prior molded plastic drawers. Simultaneously the drawer of the present invention achieves superior guiding as it is moved into and out of the cabinet due to the engagement of the guide members of the bottom wall with the lower spaced, parallel guide rails of the cabinet and the engagement of the grooves of the back wall with the upper spaced, parallel guide rails of the cabinet.

Although preferred embodiments of the invention have been illustrated in the accompanying Drawings and described in the foregoing Detailed Description, it will be understood that the invention is not limited to the embodiments disclosed, but is capable of numerous rearrangements, modifications and substitutions of parts and elements without departing from the spirit of the invention.

What is claimed is:

1. A molded plastic drawer for a cabinet having spaced, parallel upper and lower guide rails which comprises a normally horizontal bottom wall including front, side and back edges; guide members formed integrally with and disposed on the underside of the bottom wall, said guide members being positioned adjacent to the back edge and extending forwardly therefrom and being spaced apart to receive the lower guide rails of the cabinet; back and side walls formed integrally with and rising upwardly and slightly outwardly from the back and side edges of the bottom wall; a front wall integrally formed with and rising upwardly from the front edge of the bottom wall; an outwardly extending lip on the back and side walls and formed integrally therewith, the lip of the back wall being positioned above the lips of the side walls to provide an elongate shoulder for restraining the drawer in the opened condition and including grooves for receiving the upper guide rails of the cabinet.

2. The molded plastic drawer according to claim 1 wherein the front wall extends substantially perpendicularly to the bottom wall and is adapted to receive drawer hardware.

3. The molded plastic drawer according to claim 1 wherein at least the side walls have a plurality of ribs formed integrally therewith and extending outwardly therefrom, each of said ribs extending first downwardly from the outer edge of the lip and then inwardly to define a stacking lug aligned with and spaced a predetermined distance from the corresponding portion of the lip to prevent excessive nesting of stacked drawers.

4. A molded plastic drawer adapted for use in a space defined by a front frame having at least parallel top and bottom transversely extending members, spaced, parallel top rails extending rearwardly from said top frame member, and spaced, parallel bottom rails extending rearwardly from said bottom frame member, said drawer comprising:

a generally horizontal bottom wall extending to normally substantially vertical front, side and back walls formed integrally with the bottom wall;

said drawer being adapted for support by engagement of the bottom wall with the front frame member and the bottom rails;

said back wall having a shoulder formed integrally therewith and extending substantially across the width of said back wall, said shoulder projecting vertically to a height greater than the spacing between said top and bottom frame members whereby said shoulder will retain the drawer in an opened condition by substantially full width engagement with said top frame member; and guide means comprising grooves in said shoulder for receiving said top rails whereby said drawer is guided during its entire opening and closing travel so as to prevent skewing of the drawer;

said side and back walls having integrally formed therewith an upper outwardly turned lip extending first parallel to the bottom wall along one side wall and around the adjacent rear corner, then upwardly to define one end of the shoulder of the back wall, then along the top of the shoulder, then downwardly to define one side of one of the grooves, then parallel to the bottom wall to define the bottom of said groove, then upwardly to define the opposite side of said groove, then along the top of the shoulder, then downwardly to define one side of the other groove, then parallel to the bottom wall to define the bottom of said groove, then upwardly to define the opposite side of said groove, then along the top of the shoulder, then downwardly to define the opposite end of the shoulder, then parallel to the bottom wall around the opposite rear corner and along the opposite side wall.

5. The molded plastic drawer according to claim 4 further characterized by a pair of spaced, substantially parallel guide members formed on the underside of the bottom wall and extending forwardly from the back wall for receiving the bottom rails and thereby further guiding the drawer during its opening and closing travel.

6. The molded plastic drawer according to claim 4 further characterized by:

each of said side walls having formed integrally therewith a plurality of ribs extending outwardly therefrom for reinforcing the wall and the lip; and each of said ribs extending first downwardly from the lip then inwardly to define a stacking lug aligned with and positioned a predetermined distance from the corresponding portion of the lip for preventing excessive nesting of stacked drawers.

7. A molded plastic drawer adapted for use in a space defined by a front frame having at least parallel top and bottom transversely extending members; spaced, parallel guide rails extending rearwardly from said top frame member; and spaced, parallel guide rails extending rearwardly from said bottom frame member, said drawer comprising:

a normally horizontal bottom wall extending to normally substantially vertical front, side and back walls each formed integrally with the bottom wall;

said back wall having a shoulder formed integrally therewith and extending substantially across the width thereof and projecting vertically to a height greater than the spacing between said top and bottom frame members whereby the shoulder functions to retain the drawer in an opened condition by substantially full width engagement with the top frame member; and guide means comprising a pair of spaced apart grooves formed in the shoulder for receiving the top guide rails and spaced apart sets of longitudinally disposed, substantially parallel guide members formed integrally with and extending forwardly along the underside of the bottom wall from points adjacent the back wall for receiving the bottom guide rails, whereby the drawer is guided during its entire opening and closing travel so as to prevent skewing of the drawer.

8. The combination according to claim 7 wherein the molded plastic drawer is further characterized by an outwardly turned lip formed along the upper edges of the side and back walls and extending first parallel to the bottom wall along the upper edge of one side wall and around the adjacent rear corner, then upwardly to define one end of the shoulder, then parallel to the bottom wall along the top of the shoulder, then downwardly to define one side of one of the grooves, then parallel to the bottom wall to define the bottom of said groove, then upwardly to define the opposite side of said groove, then downwardly to define one side of the other groove, then parallel to the bottom wall to define the bottom of said groove, then upwardly to define the opposite side of said groove, then along the top of the shoulder, then parallel to the bottom wall along the top of the shoulder, then downwardly to define the opposite end of the shoulder, then parallel to the bottom wall around the opposite rear corner and along the opposite side wall.

9. The combination according to claim 8 wherein each of the side walls is further provided with a plurality of outwardly extending ribs serving to reinforce the walls and the lip, each of said ribs extending first downwardly from the lip and then inwardly to define a stacking lug positioned in alignment with and spaced a predetermined distance from the corresponding portion of the lip and thereby serving to prevent excessive nesting of stacked drawers.

10. The combination according to claim 7 wherein the molded plastic drawer is further characterized by an outwardly turned lip extending continuously along the upper edge of both side walls, around both rear corners, along the top of the shoulder of the back wall, and through the grooves formed in the shoulder to receive the top guide rails.

* * * * *